US008538640B2

(12) United States Patent
Ota

(10) Patent No.: US 8,538,640 B2
(45) Date of Patent: Sep. 17, 2013

(54) TRAVEL DAMPER CONTROL DEVICE FOR WHEEL LOADER

(75) Inventor: Toshiyuki Ota, Komatsu (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/582,684

(22) PCT Filed: Dec. 22, 2011

(86) PCT No.: PCT/JP2011/079860
§ 371 (c)(1),
(2), (4) Date: Sep. 4, 2012

(87) PCT Pub. No.: WO2012/086774
PCT Pub. Date: Jun. 28, 2012

(65) Prior Publication Data

US 2012/0330517 A1 Dec. 27, 2012

(30) Foreign Application Priority Data

Dec. 24, 2010 (JP) ..... 2010-0288264

(51) Int. Cl.
*E02F 3/43* (2006.01)

(52) U.S. Cl.
USPC ..... 701/50; 60/413

(58) Field of Classification Search
CPC ..... E02F 9/2207; E02F 9/2214; E02F 9/2217
USPC ..... 701/50; 60/413, 469
See application file for complete search history.

(56) References Cited

U.S. PATENT DOCUMENTS

| | | | | |
|---|---|---|---|---|
| 3,867,750 | A * | 2/1975 | Den Bleyker | 29/891 |
| 4,439,089 | A * | 3/1984 | Anderson et al. | 414/722 |
| 5,116,188 | A * | 5/1992 | Kurohashi et al. | 414/719 |
| 5,147,172 | A | 9/1992 | Hosseini | |
| 5,235,809 | A * | 8/1993 | Farrell | 60/445 |
| 5,333,533 | A * | 8/1994 | Hosseini | 91/361 |
| 5,520,499 | A * | 5/1996 | Ufheil et al. | 414/685 |
| 6,461,099 | B1 * | 10/2002 | Gosz | 414/701 |
| 7,165,395 | B2 * | 1/2007 | Anderson et al. | 60/413 |
| 7,530,434 | B2 | 5/2009 | Bitter | |
| 8,037,807 | B2 * | 10/2011 | Callaghan et al. | 91/361 |
| 2008/0295679 | A1 * | 12/2008 | Callaghan et al. | 91/1 |

FOREIGN PATENT DOCUMENTS

| | | | |
|---|---|---|---|
| EP | 0 381 788 | A1 | 8/1990 |
| JP | 60-85345 | U | 6/1985 |
| JP | 01214623 | A * | 8/1989 |

(Continued)

OTHER PUBLICATIONS

International Search Report of corresponding PCT Application No. PCT/2011/079860, (2012).

(Continued)

*Primary Examiner* — James Trammell
*Assistant Examiner* — David Testardi
(74) *Attorney, Agent, or Firm* — Global IP Counselors, LLP

(57) ABSTRACT

A travel damper control device includes a proximity detecting part and a valve switching part. The proximity detecting part is configured to detect that the bell crank is in proximity to the cross tube. The valve switching part is configured to switch the open/close valve into a closed position when the proximity detecting part detects that the bell crank is in proximity to the cross tube.

9 Claims, 6 Drawing Sheets

(56) References Cited

FOREIGN PATENT DOCUMENTS

| | | | |
|---|---|---|---|
| JP | 4-73058 | U | 6/1992 |
| JP | 5-209422 | A | 8/1993 |
| JP | 2000-319919 | A | 11/2000 |
| JP | 2001-80895 | A | 3/2001 |
| JP | 2005-119784 | A | 5/2005 |
| JP | 2007-186942 | A | 7/2007 |
| WO | WO 2008/143965 | A2 * | 11/2008 |

OTHER PUBLICATIONS

Extended European Search Report for the corresponding European patent application No. 11851592.3, issued on Jul. 17, 2013.

* cited by examiner

TRAVEL DAMPER CONTROL DEVICE FOR WHEEL LOADER

CROSS-REFERENCE TO RELATED APPLICATIONS

This application claims priority to Japanese Patent Application No. 2010-288264 filed on Dec. 24, 2010, the disclosure of which is hereby incorporated herein by reference in its entirety.

TECHNICAL FIELD

The present invention relates to a travel damper control device mounted on a wheel loader.

BACKGROUND ART

In general, wheel loaders are not provided with a suspension system for absorbing vibration of a vehicle body in order to efficiently utilize driving force for works such as digging. Therefore, chances are that a load such as earth and sand, loaded on a work implement (e.g., a bucket) attached to the tips of a pair of booms, drops due to vibration of the vehicle body during travelling.

In view of the above, methods of providing a travel damper formed by boom cylinders and an accumulator communicated with the boom cylinders have been proposed (see Japan Laid-open Patent Application Publication Nos. H05-209422 and 2007-186942). In the method described in Japan Laid-open Patent Application Publication No. H05-209422, the accumulator is configured to be coupled to the boom cylinders when the vehicle speed of a wheel loader is greater than or equal to a predetermined value. In the method described in Japan Laid-open Patent Application Publication No. 2007-186942, a control of accumulating pressure in the accumulator is executed depending on at least either of the vehicle speed of the wheel loader and a position of a front/rear travel lever.

SUMMARY

However, the methods described in Japan Laid-open Patent Application Publication Nos. H05-209422 and 2007-186942 do not take so-called "a rap-out" into consideration, and therefore, have a drawback as described below, it should be noted that "a nip-out" is an action of dropping earth, sand and etc. adhered to a work implement by hitting a cross tube coupling a pair of booms in a vehicle width direction with a bell crank pivotably attached to the cross tube.

When a rap-out is executed, an acute peak pressure is generated in the boom cylinder by the shock. Therefore, a drawback is produced that the peak pressure is transmitted to the accumulator from the boom cylinder if the accumulator is coupled to the boom cylinder in executing a rap-out and thereby durability of the accumulator is degraded.

The present invention has been produced in view of the aforementioned situation, and it is an object of the present invention to provide a travel damper control device and a travel damper control method whereby degradation in durability of an accumulator can be inhibited.

A travel damper control device according to a first aspect of the present invention is mounted on a wheel loader, the wheel loader including a pair of booms, a rotary shaft, a bell crank, a work implement, a boom cylinder and an accumulator, the pair of booms coupled by a cross tube arranged along a vehicle width direction, the rotary shaft arranged along the vehicle width direction and attached to the cross tube, the bell crank attached pivotably about the rotary shaft, the work implement coupled to the bell crank, the boom cylinder coupled to the pair of booms, and the accumulator communicated with the boom cylinder through an open/close valve. The travel damper control device includes a proximity detecting part configured to detect that the bell crank is in proximity to the cross tube and a valve switching part configured to switch the open/close valve into a closed position when the proximity detecting part detects that the bell crank is in proximity to the cross tube.

According to the travel damper control device for a wheel loader of the first aspect of the present invention, the open/close valve is configured to be switched into the closed position at a point of time when it is detected that the bell crank is in proximity to the cross tube. In other words, it is possible to quickly block communication between the boom cylinder and the accumulator before the cross tube is hit with the bell crank. It is thereby possible to inhibit an acute peak pressure, generated in the boom cylinder in executing a rap-out, from being transmitted to the accumulator. Therefore, it is possible to inhibit degradation in durability of the accumulator.

A travel damper control device according to a second aspect of the present invention relates to the first aspect, the proximity detecting part is configured to detect that the bell crank is in proximity to the cross tube when an inner angle formed by the pair of booms and the bell crank becomes less than or equal to a first angle in a side view of the wheel loader.

According to the travel damper control device of the second aspect of the present invention, proximity of the bell crank can be detected based on the inner angle formed by the booms and the bell crank. Therefore, it is possible to further easily and accurately detect proximity of the bell crank compared to cases such as a case that the interval between the bell crank and the cross tube is directly measured.

A travel damper control device according to a third aspect of the present invention relates to the second aspect, the proximity detecting part is configured to continuously detect that the bell crank is in proximity to the cross tube while the inner angle is less than or equal to a second angle greater than the first angle after the inner angle becomes less than or equal to the first angle.

According to the travel damper control device for a wheel loader of the third aspect of the present invention, the second angle is greater than the first angle, and therefore, the travel damper is configured to be tuned OFF until the bell crank is sufficiently separated away from the cross tube after the bell crank once gets closer to the cross tube. Accordingly, it is possible to inhibit the travel damper from being repeatedly turned ON and OFF uselessly in a short period of time.

A travel damper control device according to a fourth aspect of the present invention relates to one of the first to third aspects, the travel damper further includes an angular rate obtaining part configured to configured to obtain an angular rate of the bell crank pivoting about the rotary shaft. The valve switching part is configured to keep the open/close valve in an opened position when the angular rate of the bell crank is less than or equal to a predetermined threshold. According to the travel damper control device for a wheel loader of the fourth aspect of the present invention, it is possible to inhibit the travel damper from being repeatedly turned ON and OFF uselessly when it is less required to block the boom cylinder from communicating with the accumulator.

According to the present invention, it is possible to provide a travel damper control device and a travel damper control method whereby degradation in durability of an accumulator can be inhibited.

DESCRIPTION OF EMBODIMENTS

Figure 1:
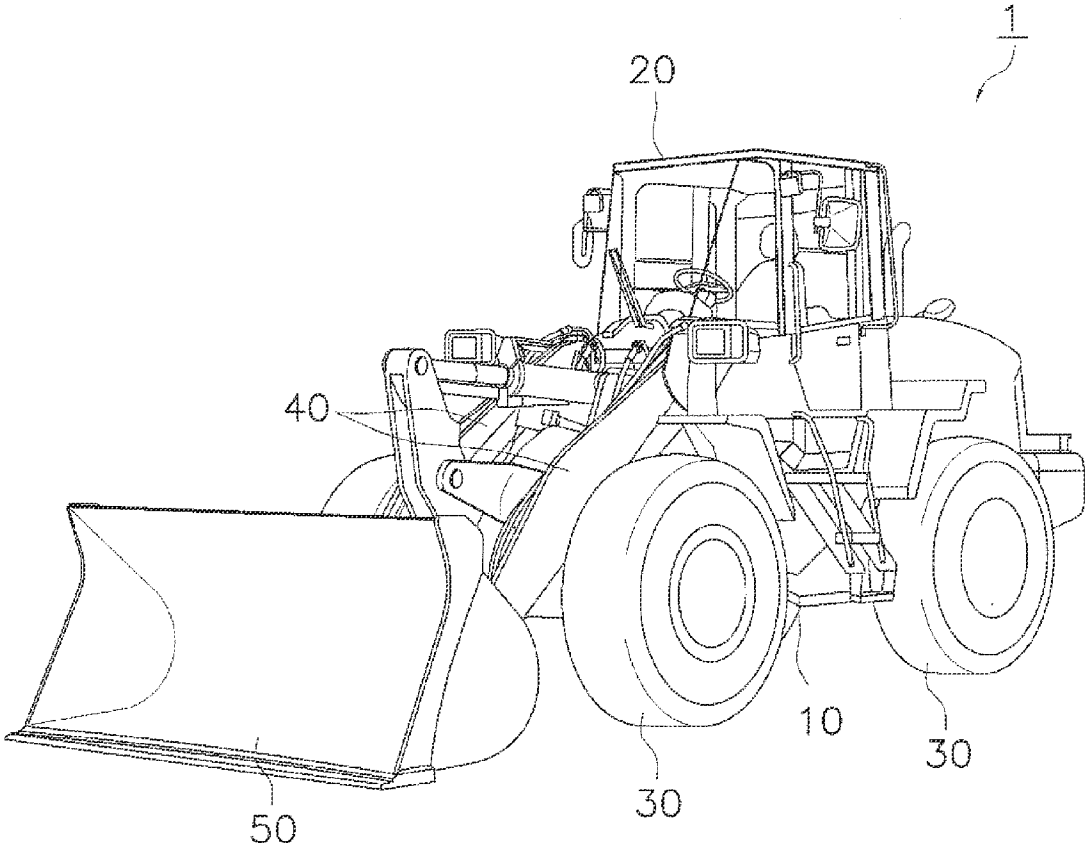
FIG. 1 is a perspective view of a wheel loader 1 according to an exemplary embodiment.

Next, an exemplary embodiment of the present invention will be explained using figures. In the following description of the figures, the same or similar reference numeral is given to the same or similar elements. It should be noted that the figures are schematic only and respective dimensional ratios and etc. of the figures may be different from actual ones. Therefore, specific dimensions and etc. should be judged in view of the following explanation. Further, it is apparent that dimensional relations and ratios of corresponding parts/portions/sections are different among the figures.

Overall Structure of Wheel Loader 1

The structure of a wheel loader 1 according to an exemplary embodiment will be explained with reference to the figures. FIG. 1 is a perspective view of the wheel loader 1 according to the present exemplary embodiment.

The wheel loader 1 includes a vehicle body frame 10, a cab 20, four tires 30, a pair of booms 40 and a bucket 50 (an exemplary "work implement").

The vehicle body frame 10 has so-called an articulate structure. The cab 20 is mounted on the vehicle body frame 10. The cab 20 accommodates a seat, an operating tool and etc. not illustrated in the figure. The four tires 30 support the vehicle body frame 10. The booms 40 of the pair are disposed while being opposed to each other in the vehicle width direction. The pair of booms 40 is pivotably supported by the front end of the vehicle body frame 10. The bucket 50 is pivotably supported by the front ends of the booms 40 of the pair.

Figure 2:
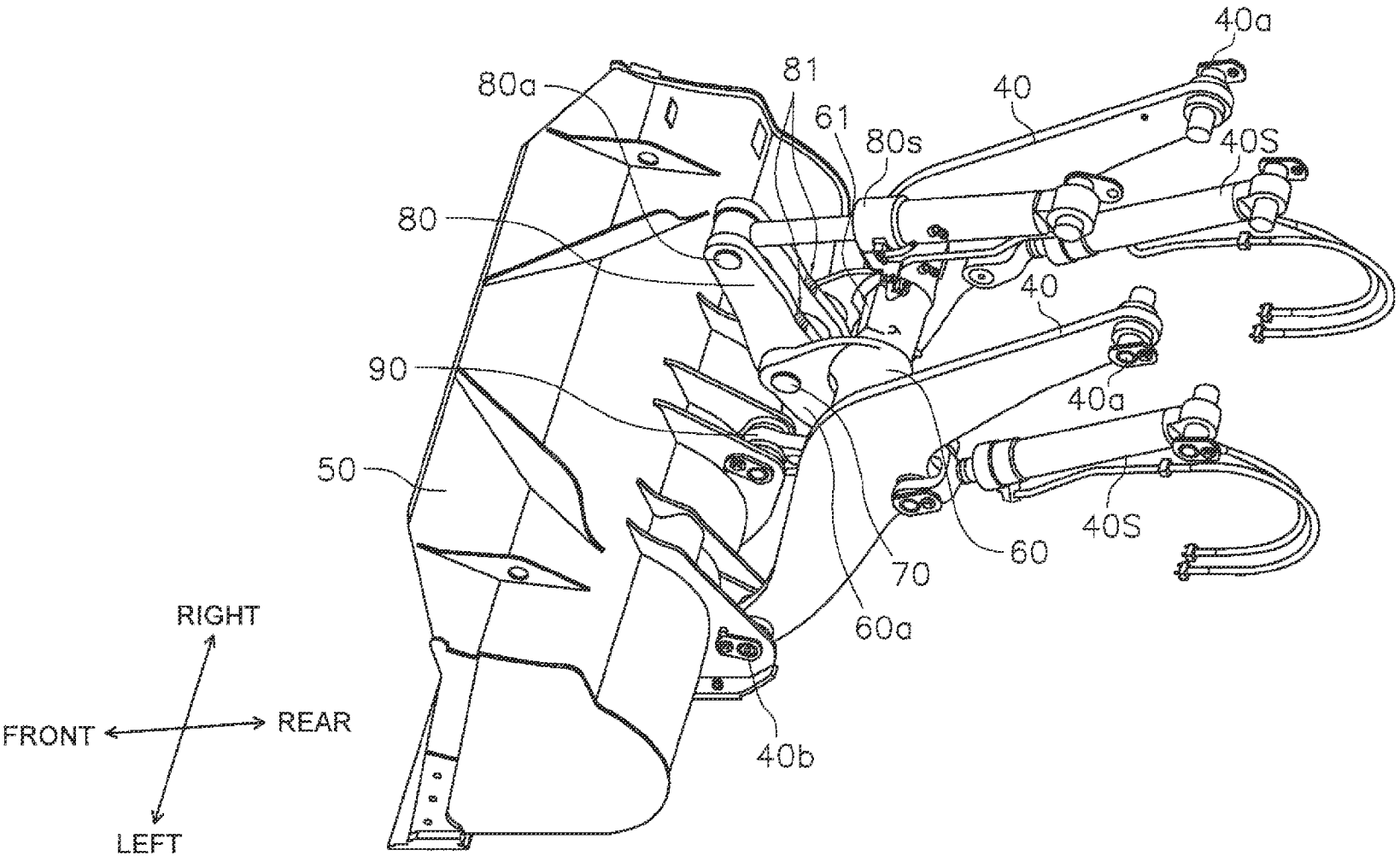
FIG. 2 is a perspective view illustrating a support structure of a bucket 50 according to the exemplary embodiment.

Now, FIG. 2 is a perspective view illustrating the support structure of the bucket 50 according to the exemplary embodiment. The wheel loader it includes a cross tube 60, a rotary shaft 70, a bell crank 80, a link 90, a pair of boom cylinders 40S and a bucket cylinder 80S.

The cross tube 60 is arranged along the vehicle width direction. The cross tube 60 couples the booms 40 of the pair. The cross tube 60 has a support portion 60*a* for supporting the bell crank 80. The support portion 60*a* is disposed while being protruded forwardly upwards from the cross tube 60.

The rotary shaft 70 is arranged along the vehicle width direction. The rotary shaft 70 is attached to the support portion 60*a*. The rotary shaft 70 is inserted through the center part of the bell crank 80.

The bell crank 80 is supported by the support position 60*a* through the rotary shaft 70. The bell crank 80 is pivotable about the rotary shaft 70. The bell crank 80 has a cylinder shaft portion 80*a* disposed at the end thereof in the vehicle width direction.

The link 90 is coupled to the bucket 50 and the bell crank 80. The link 90 transmits vibration of the bell crank 80 to the bucket 50. Accordingly, the posture (i.e., a tilt/dump angle) of the bucket 50 is controlled.

The boom cylinders 40S of the pair are coupled to the vehicle body frame 10 and the booms 40 of the pair. The pair of boom cylinders 40S is configured to be extended and contracted by operating oil to be supplied to the inside thereof. Accordingly, the pair of booms 40 is configured to be pivoted up and down. It should be noted that each of the booms 40 of the pair is supported about a first shaft portion 40*a* by the vehicle body frame 10, while being supported about a second shaft portion 40*b* by the bucket 50. In the present exemplary embodiment, the pair of boom cylinders is communicated with an accumulator 130 through an open/close valve 120 (see FIG. 4). A hydraulic circuit 100, fanning a part of a travel damper, will be explained below.

The bucket cylinder 80S is coupled to the vehicle body frame 10 and the bell crank 80. The front end of the bucket cylinder 80S is supported about the cylinder shaft portion 80*a* of the bell crank 80. The bucket cylinder 80S is configured to be extended and contracted by operating oil to be supplied to the inside thereof. Accordingly, the bucket 50 is configured to be dumped and tilted.

Now, as illustrated in FIG. 2, the cross tube 60 has a dump stopper 61 while the bell crank 80 has a stopper contact portion 81. In executing "a rap-out", an operator hits the dump stopper 61 with the stopper contact portion 81. "A rap-out" is an action of dropping earth, sand and etc. adhered to the inner surface of the bucket 50 by the shock in hitting the dump stopper 61 with the stopper contact portion 81.

Positional Relation Between Boom 40 and Bell Crank 80

Figure 3:
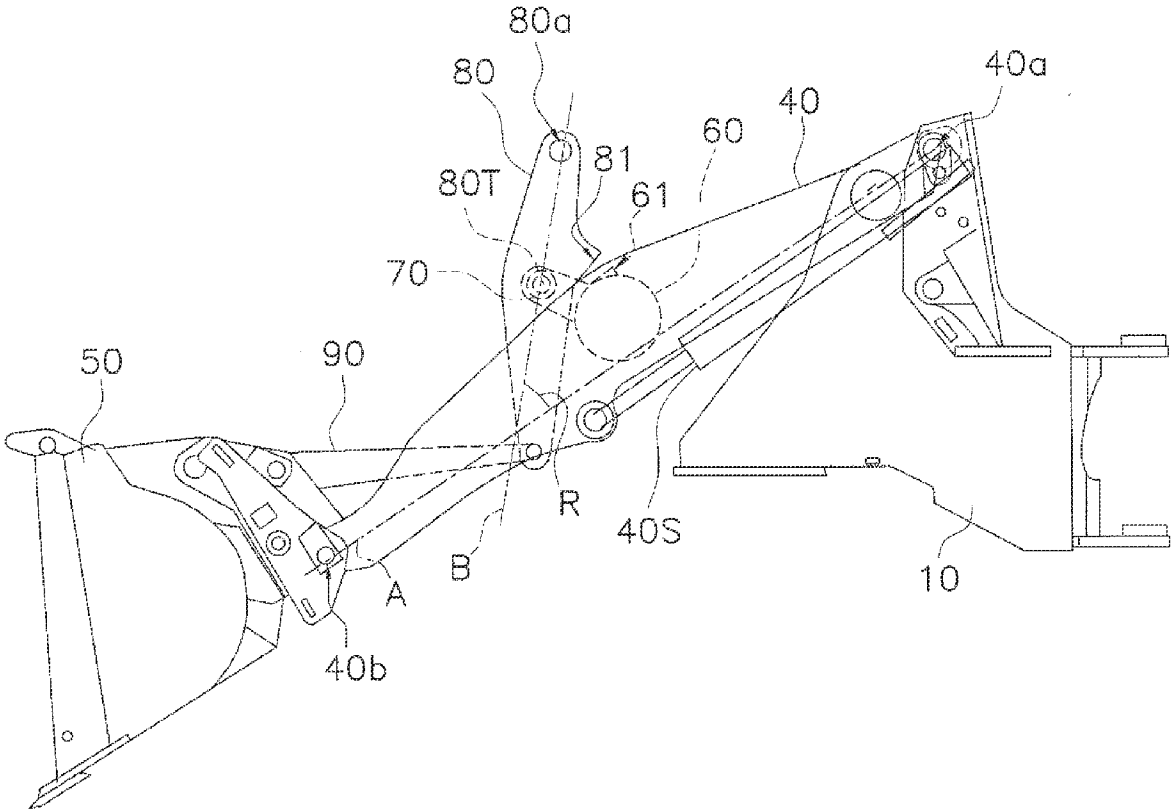
FIG. 3 is a side view illustrating a positional relation between booms 40 and a bell crank 80 according to the exemplary embodiment.

The positional relation between the booms 40 and the bell crank 80 according to the present exemplary embodiment will be explained with reference to the figure. FIG. 3 is a side view illustrating the positional relation between the booms 40 and the bell crank 80. It should be noted that FIG. 3 illustrates a state immediately before execution of a rap-out.

In executing a rap-out, the dump stopper 61 of the cross tube 60 is hit with the stopper contact portion 81 of the bell crank 80. In this case, an inner angle R formed by the pair of booms 40 and the bell crank 80 indicates a limit value $\alpha$ in a side view. In other words, when the inner angle R is the limit value $\alpha$, the stopper contact portion 81 of the bell crank 80 makes contact with the dump stopper 61 of the cross tube 60.

As illustrated in FIG. 3, the inner angle R is herein an angle ($<90°$) formed by a boom baseline A and a bell crank baseline B. The boom baseline A is a straight line connecting the first shaft portion 40*a* and the second shaft portion 40*b* of the booms 40. The bell crank baseline B is a straight line connecting the cylinder shaft portion 80*a* of the bell crank 80 and the rotary shaft 70.

Further, the inner angle R is detected by a bell crank angle sensor 80T disposed on the rotary shaft 70. The bell crank angle sensor 80T detects an angle of the bell crank 80 rotated about the rotary shaft 70 from a baseline position.

Structure of Hydraulic Circuit 100

Figure 4:
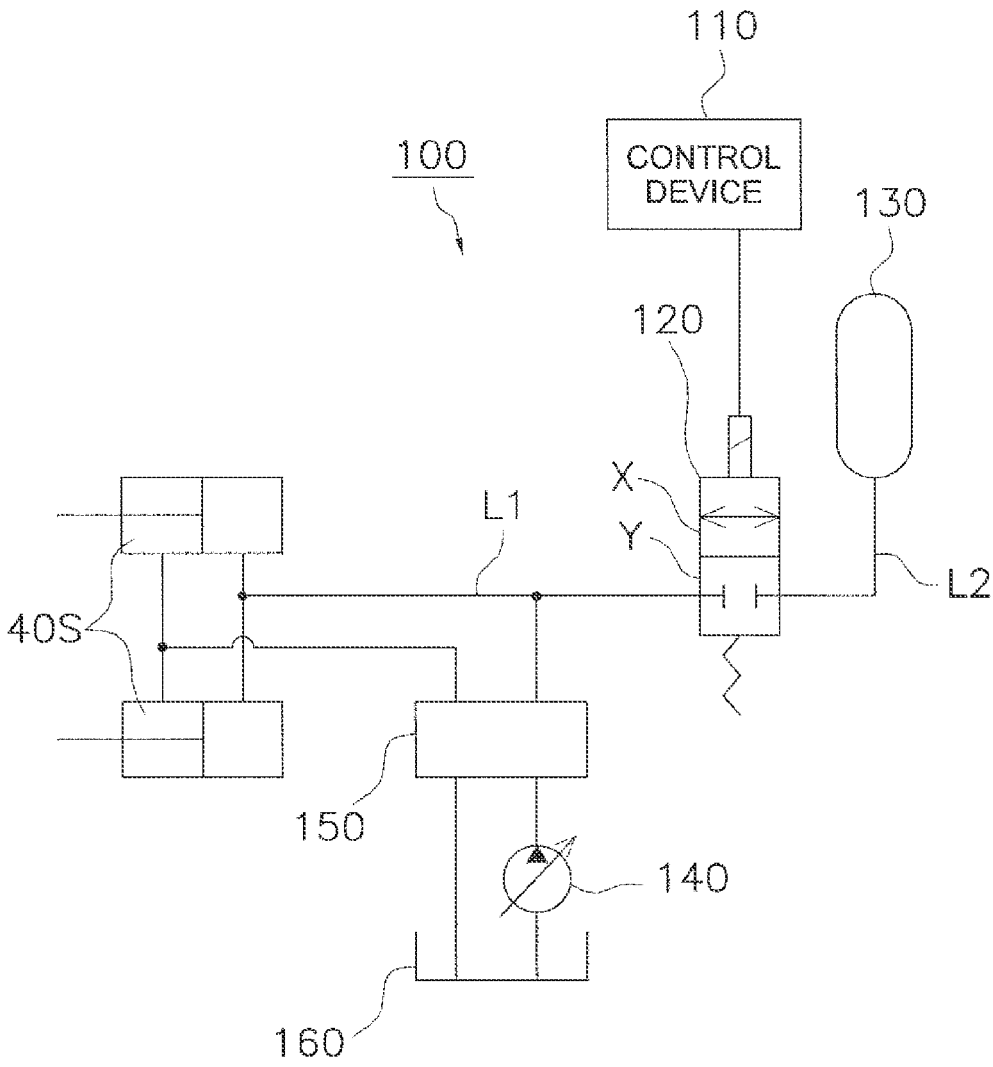
FIG. 4 is a circuit diagram representing a configuration of a hydraulic circuit 100 according to the exemplary embodiment.

The configuration of the hydraulic circuit 100 according to the present exemplary embodiment will be explained with reference to the figures. FIG. 4 is a circuit diagram representing the configuration of the hydraulic circuit 100 according to the present exemplary embodiment. The hydraulic circuit 100 forms the travel damper of the wheel loader 1.

The hydraulic circuit 100 includes a control device 110, the open/close valve 120, the accumulator 130, a hydraulic pump 140, a boom cylinder control valve 150 and an operating oil tank 160.

The control device 110 is configured to switch the position of the open/close valve 120 for executing an on/off control of the travel damper of the wheel loader 1. The configuration and action of the control device 110 will be described below.

The open/close valve 120 is a dual-position switching valve having an opened position X and a closed position Y When located in the opened position X, the open/close valve 120 is communicated with an oil path L1 and an oil path L2. Accordingly, the travel damper of the wheel loader 1 is turned ON. When located in the closed position Y, the open/close valve 120 blocks communication between the oil path L1 and the oil path L2. Accordingly, the travel damper of the wheel loader 1 is turned OFF.

The accumulator 130 functions as a damper mechanism for attenuating vibration of the boom cylinders 40S when communicated with the boom cylinders 40S through the open/close valve 120. On the other hand, the accumulator 130 does not function as a damper mechanism when blocked from communicating with the boom cylinders 40S by the open/close valve 120.

The hydraulic pump 140 is driven by an engine (not illustrated in the figures). The hydraulic pump 140 is configured to supply the operating oil stored in the operating oil tank 160 to the pair of boom cylinders 40S through the boom cylinder control valve 150.

Structure of Control Device 110

Figure 5:
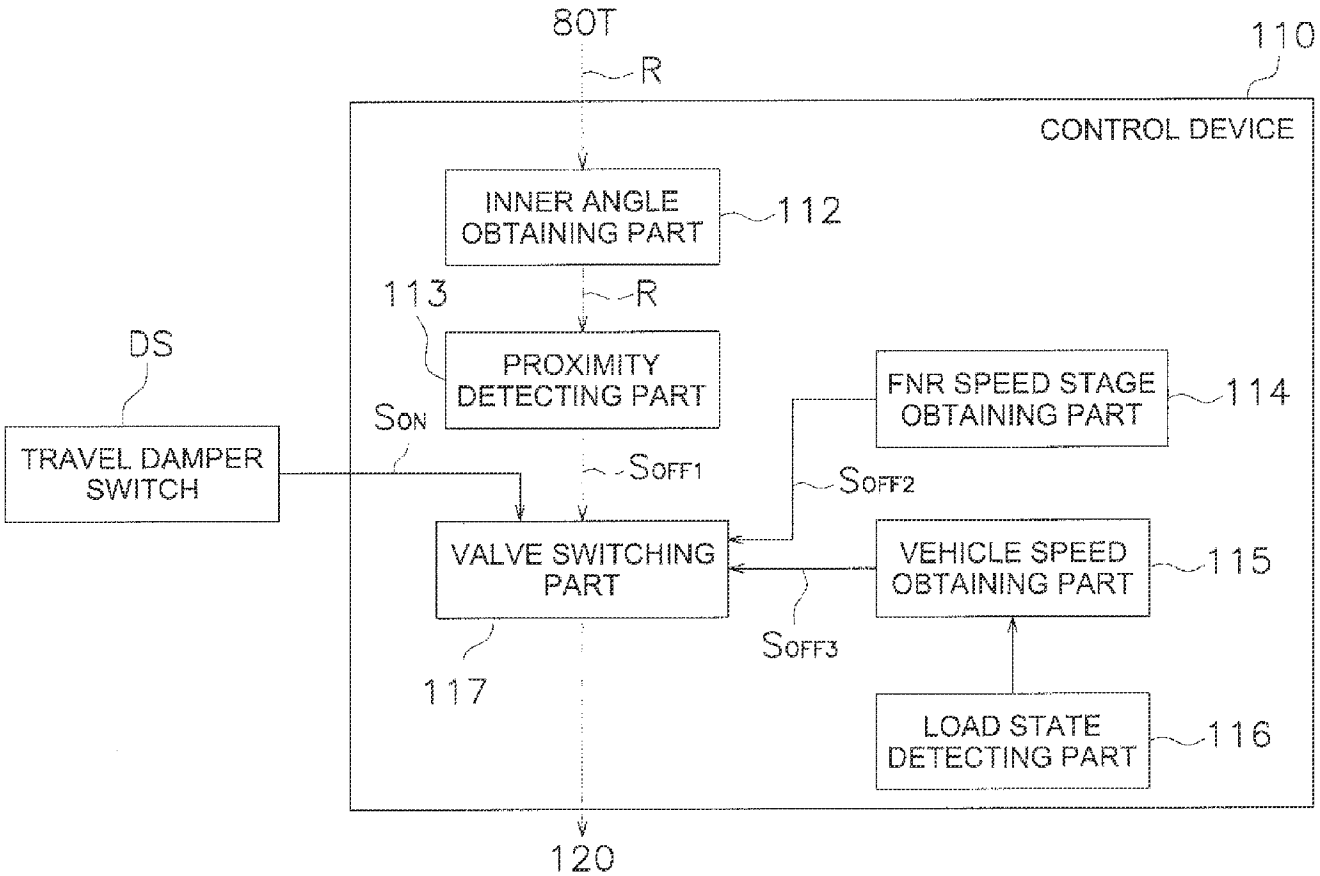
FIG. 5 is a block diagram representing a configuration of a control device 110 according to the exemplary embodiment.

The configuration of the control device 110 according to the present exemplary embodiment will be explained with reference to the figures. FIG. 5 is a block diagram representing the configuration of the control device 110 according to the present exemplary embodiment.

The control device 110 includes an inner angle obtaining part 112, a proximity detecting part 113, an FNR speed stage obtaining part 114, a vehicle speed obtaining part 115, a load state detecting part 116 and a valve switching part 117.

The inner angle obtaining part 112 is configured to obtain the inner angle R formed by the pair of booms 40 and the bell crank 80 from the bell crank angle sensor 80T on a real-time basis. The inner angle obtaining part 112 is configured to transmit the inner angle R to the proximity detecting part 113.

The proximity detecting part 113 is configured to detect that the bell crank 80 is in proximity to the cross tube 60. In the present exemplary embodiment, the proximity detecting part 113 is configured to determine whether or not the inner angle R formed by the booms 40 and the bell crank 80 is less than or equal to a first angle R1 (the limit value $\alpha+\Delta r$: $\Delta r$ is a positive number). The proximity detecting part 113 is configured to output a first OFF signal $S_{OFF1}$ to the value switching part 117 when the inner angle R is less than or equal to the first angle R1.

Further, the proximity detecting part 113 is configured to determine whether or not the inner angle R is less than or equal to a second angle R2 (the limit value $\alpha+\Delta s$: $\Delta s$ is a positive number greater than $\Delta r$) greater than the first angle R1 after once determining that the inner angle R is less than or equal to the first angle R1. The proximity detecting part 113 is configured to output the first OFF signal $S_{OFF1}$ to the valve switching part 117 when the inner angle R is less than or equal to the second angle R2.

The FNR speed stage obtaining part 114 is configured to obtain an operating position signal indicating the operating position of a shill lever to be operated by an operator. The operating position signal indicates which of the following states the wheel loader 1 is in: a forward travelling state; a rearward travelling state; and a neutral state and indicates which of the first to fourth speed stages a transmission device is in. The FNR speed stage obtaining part 114 is configured to output a second OFF signal $S_{OFF2}$ to the value switching part 117 when the operating position signal indicates either the neutral state or the first speed stage.

The vehicle speed obtaining part 115 is configured to obtain the vehicle speed of the wheel loader 1, for instance, from a vehicle speed meter. The vehicle speed obtaining part 115 is configured to output a third OFF signal $S_{OFF3}$ to the value switching part 117 when the vehicle speed is less than or equal to a predetermined speed (e.g., 5 km/h). It should be noted that the vehicle speed obtaining part 115 is configured not to output the third OFF signal $S_{OFF3}$ to the value switching part 117 when the load state detecting part 116 detects that the bucket 50 contains a load.

The load state detecting part 116 is configured to detect whether or not the bucket 50 contains a load based on, for instance, the cylinder bottom pressure of each of the boom cylinders 40s of the pair. The load state detecting part 116 is configured to output the detection result to the vehicle speed obtaining part 115.

The valve switching part 117 is configured to receive an ON signal $S_{ON}$ from a travel damper switch DS when an operator turns ON the travel damper switch DS. The valve switching part 117 is configured to switch the open/close valve 120 into the opened position X in response to receipt of the ON signal $S_{ON}$. It should be noted that the valve switching part 117 is configured to switch the open/close valve 120 into the closed position Y while at least one of the first to firth OFF signals $S_{OFF1}$ to $S_{OFF3}$ is being inputted.

Actions of Control Device 100

Figure 6:
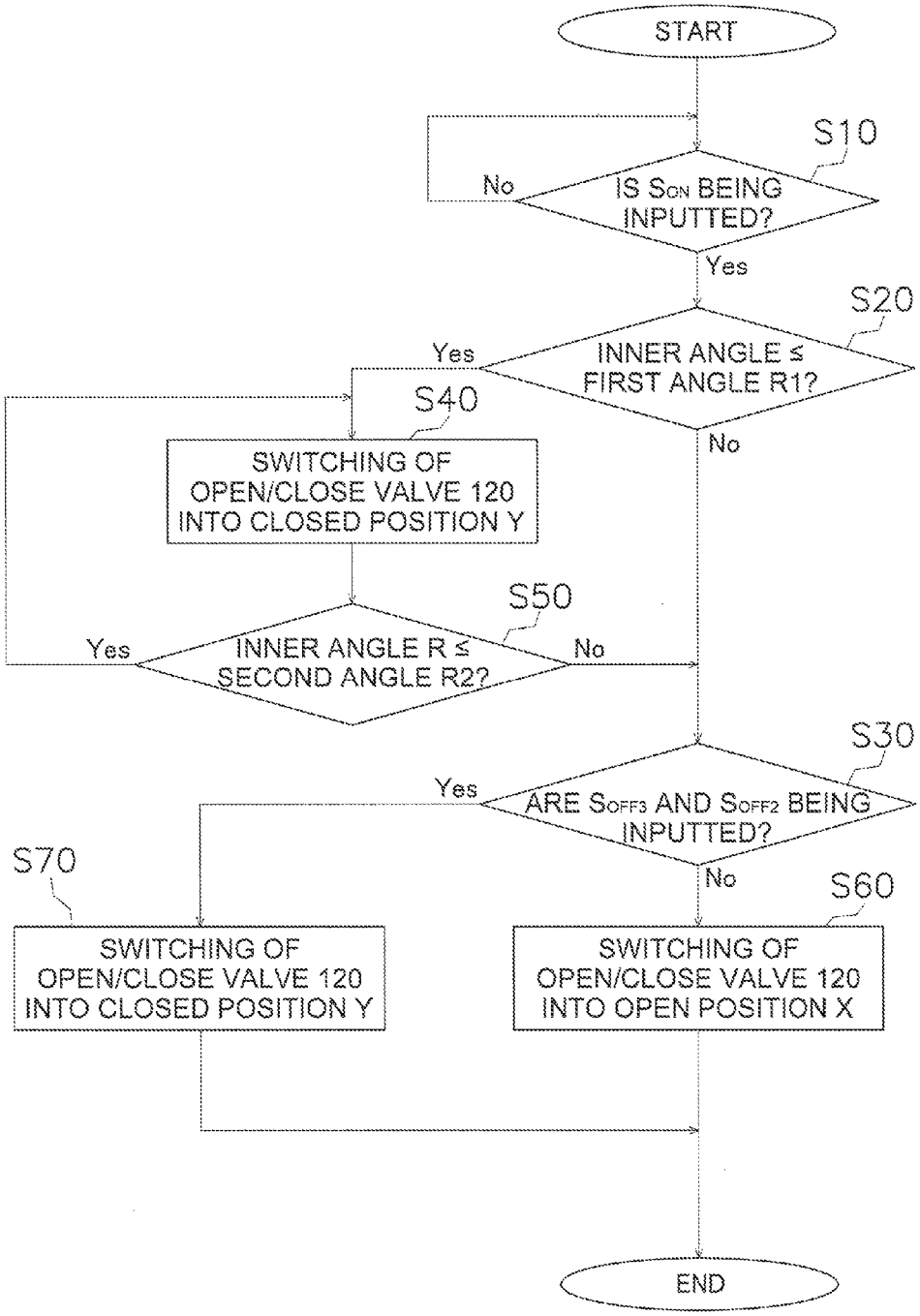
FIG. 6 is a flowchart representing actions of the control device 110 according to the exemplary embodiment.

Actions of the control device 110 according to the present exemplary embodiment will be explained with reference to the figures. FIG. 6 is a flowchart representing the actions of the control device 110 according to the present exemplary embodiment.

In Step S10, the control device 110 determines whether or not the ON signal $S_{ON}$ is being inputted. The processing repeats Step S10 when the ON signal $S_{ON}$ is not being inputted. The processing proceeds to Step S20 when the ON signal $S_{ON}$ is being inputted.

In Step S20, the control device 110 determines whether or not the inner angle R formed by the booms 40 and the bell crank 80 is less than or equal to the first angle R1 (the limit value $\alpha+\Delta r$). The processing proceeds to Step S30 when the inner angle R is not less than or equal to the first angle R1. The processing proceeds to Step S40 when the inner angle R is less than or equal to the first angle R1.

In Step S30, the control device 110 determines whether or not the second OFF signal $S_{OFF2}$ and the third OFF Signal $S_{OFF3}$ are being inputted. The processing proceeds to Step S60 when the second OFF signal $S_{OFF2}$ and the third OFF signal $S_{OFF3}$ are not being inputted. The processing proceeds to Step S70 when at least either of the second OFF signal $S_{OFF2}$ and the third OFF signal $S_{OFF3}$ is being inputted.

In Step S40, the control device 110 switches the open/close valve 120 into the closed position Y. Accordingly, the travel damper of the wheel loader 1 is turned OFF.

In Step S50, the control device 110 determines whether or not the inner angle R formed by the booms 40 and the bell crank 80 is less than or equal to the second angle R2 (>the first angle R1). The processing proceeds to Step S30 when the inner angle R is not less than or equal to the second angle R2. The processing repeats Step S40 when the inner angle R is less than or equal to the second angle R2.

In Step S60, the control device 110 switches the open/close valve 120 into the opened position X. Accordingly, the travel damper of the wheel loader 1 is turned ON.

In Step S70, the control device 110 switches the open/close valve 120 into the closed position Y. Accordingly, the travel damper of the wheel loader 1 is turned OFF.

Actions and Effects (1) The control device 100 according to the present exemplary embodiment includes the proximity detecting part 113 and the valve switching part 117. The proximity detecting part 113 is configured to detect that the bell crank 80 is in proximity to the cross tube 60. The valve switching part 117 configured to switch the open/close valve 120 into the closed position Y when it is detected that the bell crank 80 is in proximity to the cross tube 60.

Thus, the open/close valve 120 is configured to be switched into the closed position Y at a point of time when it is detected that the bell crank 80 is in proximity to the cross tube 60. In other words, it is possible to quickly block communication between the boom cylinders 80S and the accumulator 130 before the cross tube 60 is hit with the bell crank 80. It is thereby possible to inhibit an acute peak pressure, generated in the boom cylinders 80S in executing a rap-out, from being transmitted to the accumulator 130. Therefore, it is possible to inhibit degradation in durability of the accumulator 130.

(2) In the control device 100 according to the present exemplary embodiment, the proximity detecting part 113 is configured to detect that the bell crank 80 is in proximity to the cross tube 60 when the inner angle R formed by the pair of booms 40 and the bell crank 80 becomes less than or equal to the first angle R1.

Thus, it is possible to detect proximity of the bell crank 80 based on the inner angle R formed by the booms 40 and the bell crank 80. Therefore, it is more simply and accurately detect proximity of the bell crank 80 than cases such as a case that the interval between the bell crank 80 and the cross tube 60 is directly measured.

(3) In the control device 100 according to the present exemplary embodiment, the proximity detecting part 113 is configured to continuously detect that the bell brank 80 is in proximity to the cross tube 60 while the inner angle R is less than or equal to the second angle R2 R1) after the inner angle R becomes less than or equal to the first angle R1.

Thus, the second angle R2 is greater than the first angle R1, and therefore, the travel damper is turned OFF until the bell crank 80 is sufficiently separated away from the cross tube 60 after the bell crank 80 once gets closer to the cross tube 60. It is thereby possible to inhibit the travel damper from being repeatedly turned ON and OFF uselessly in a short period of time.

Other Exemplary Embodiments

The present invention has been described with the aforementioned exemplary embodiment. However, it should not be understood that the description and figures, forming a part of this disclosure, are intended to limit the present invention. A variety of alternative embodiments, examples and operational arts would be apparent for a person skilled in the art from this disclosure.

(A) In the aforementioned exemplary embodiment, the proximity detecting part 113 is configured to detect that the bell crank 80 is in proximity to the cross tube 60 based on the inner angle R formed by the pair of booms 40 and the bell crank 80. However, the present invention is not limited to the above. For example, the proximity detecting part 113 can detect proximity of the bell crank 80 based on the stroke amount of the bucket cylinder 80S and either the stroke amount of the boom cylinders 40S or the angle of the booms 40 (which can be detected by for instance, an angle sensor mounted on the first shaft portion 40*a*). Further, the proximity detecting part 113 can also detect proximity of the bell crank 80 based on a detection result of a proximity switch configured to be actuated when the interval between the bell crank 80 and the cross tube 6 (becomes less than or equal to a predetermined value.

(B) In the aforementioned exemplary embodiment, the valve switching part 117 is configured to unexceptionally output the first OFF signal $S_{OFF1}$ when the inner angle R is less than or equal to the first angle R1. The present invention is not limited to the above. The valve switching part 117 may be configured to keep the open/close valve 120 in the opened position X when the angular speed of the bell crank 80 is less than or equal to a predetermined threshold. In this case, a small peak pressure is transmitted from the boom cylinders 80S to the accumulator 130. Therefore, it is also less required to block the boom cylinders 80 from communicating with the accumulator 130. Therefore, it is possible to inhibit the travel damper from being repeatedly turned ON and OFF uselessly. In this case, it should be noted that the wheel loader 1 is only required to include an angular speed obtaining part configured to obtain the angular speed of the bell crank 80 pivoting about the rotary shaft 70.

It is thus apparent that the present invention includes a variety of embodiments and etc. not herein described. Therefore, the technical scope of the present invention should be defined only by the matters specifying the invention related to claims that are valid from the aforementioned explanation.

According to the illustrated embodiments, it is possible to provide a travel damper control device for a wheel loader whereby degradation in durability of an accumulator can be inhibited. Therefore, the travel damper control device according to the embodiments is useful for the field of construction machines.

The invention claimed is:

1. A travel damper control device mounted on a wheel loader, the wheel loader including a pair of booms, a rotary shaft, a bell crank, a work implement, a boom cylinder and an accumulator, the pair of booms being coupled by a cross tube arranged along a vehicle width direction, the rotary shaft being arranged along the vehicle width direction and attached to the cross tube, the bell crank being attached pivotably about the rotary shaft, the work implement being coupled to the bell crank, the boom cylinder being coupled to the pair of booms, and the accumulator being communicated with the boom cylinder through an open/close valve, the travel damper control device comprising:

a proximity detecting part configured to detect that the bell crank is in proximity to the cross tube when an inner angle formed by the pair of booms and the bell crank becomes less than or equal to a first angle in a side view of the wheel loader and to continuously detect that the bell crank is in proximity to the cross tube while the inner angle is less than or equal to a second angle greater than the first angle after the inner angle becomes less than or equal to the first angled; and a valve switching part configured to switch the open/close valve into a closed position when the proximity detecting part detects that the bell crank is in proximity to the cross tube.

2. The travel damper control device according to claim 1, wherein the work implement is a bucket, and the bucket is in a posture having a tilting angle to drop earth when the proximity detecting part detects that the bell crank is in proximity to the cross tube.

3. The travel damper control device according to claim 2, wherein the cross tube is provided with a dump stopper and the bell crank is provided with a stopper contact portion, and the dump stopper is in proximity to or contacting the stopper contact portion when the proximity detecting part detects that the bell crank is in proximity to the cross tube.

4. The travel damper control device according to claim 3, wherein the proximity detecting part is configured to detect that the bell crank is in proximity to the cross tube while a rap-out operation of the bucket is executed.

5. The travel damper control device according to claim 3, wherein the stopper contact portion of the bell crank is configured to make contact with the dump stopper of the cross tube when the inner angle equals a limit value.

6. A travel damper control device mounted on a wheel loader, the wheel loader including a pair of booms, a rotary shaft, a bell crank, a work implement, a boom cylinder and an accumulator, the pair of booms being coupled by a cross tube arranged along a vehicle width direction, the rotary shaft being arranged along the vehicle width rotary shaft, the work implement being coupled to the bell crank, the boom cylinder being coupled to the pair of booms, and the accumulator being communicated with the boom cylinder through an open/close valve, the travel damper control device comprising:

a proximity detecting part configured to detect that the bell crank is in proximity to the cross tube;

an angular rate obtaining part configured to obtain an angular rate of the bell crank pivoting about the rotary shaft; and a valve switching part configured to switch the open/close valve into a closed position and to keep the open/close valve in an opened position when the angular rate of die bell crank is less than or equal to a predetermined threshold.

7. The travel damper control device according to claim 6, wherein the work implement is a bucket, and the bucket is in a posture having a tilting angle to drop earth when the proximity detecting part detects that the bell crank is in proximity to the cross tube.

8. The travel damper control device according to claim 7, wherein the cross tube is provided with a dump stopper and the bell crank is provided with a stopper contact portion, and the dump stopper is in proximity to or contacting the stopper contact portion when the proximity detecting part detects that the bell crank is in proximity to the cross tube.

9. The travel damper control device according to claim 8, wherein the proximity detecting part is configured to detect that the bell crank is in proximity to the cross tube while a rap-out operation of the bucket is executed.

* * * * *